US011266217B2

(12) United States Patent
Johnston

(10) Patent No.: US 11,266,217 B2
(45) Date of Patent: Mar. 8, 2022

(54) COLOR APPLICATION BOTTLE WITH PARTING COMB ATTACHMENT AND RELATED METHODS OF USE

(71) Applicant: CONCENTRICS, LLC, Wenatchee, WA (US)

(72) Inventor: Trudy Johnston, Wenatchee, WA (US)

(73) Assignee: Concentrics LLC, Wenatchee, WA (US)

( * ) Notice: Subject to any disclaimer, the term of this patent is extended or adjusted under 35 U.S.C. 154(b) by 70 days.

(21) Appl. No.: 16/341,418

(22) PCT Filed: Oct. 11, 2017

(86) PCT No.: PCT/US2017/056205

§ 371 (c)(1),
(2) Date: Apr. 11, 2019

(87) PCT Pub. No.: WO2018/071584

PCT Pub. Date: Apr. 19, 2018

(65) Prior Publication Data

US 2019/0239614 A1 Aug. 8, 2019

Related U.S. Application Data

(60) Provisional application No. 62/407,433, filed on Oct. 12, 2016.

(51) Int. Cl.

| | |
|---|---|
| ***A61C 19/00*** | (2006.01) |
| ***A45D 19/02*** | (2006.01) |
| ***A45D 24/28*** | (2006.01) |
| ***A45D 19/00*** | (2006.01) |

(52) U.S. Cl.
CPC ..... *A45D 19/02* (2013.01); *A45D 19/00* (2013.01); *A45D 24/28* (2013.01)

(58) Field of Classification Search
CPC ..... A45D 19/02; A45D 19/00; A45D 24/28; A45D 19/0008; A45D 2019/0066; A45D 2019/0091
USPC ..... 132/112, 212, 320
See application file for complete search history.

(56) References Cited

U.S. PATENT DOCUMENTS

| | | | | |
|---|---|---|---|---|
| 873,550 | A * | 12/1907 | Hudson | A46B 11/0041 401/39 |
| 2,895,486 | A | 7/1959 | Sayer | |
| 3,015,836 | A | 1/1962 | Maynier et al. | |
| 3,204,644 | A * | 9/1965 | McDougall-Kaley | A45D 34/041 132/212 |
| 4,209,027 | A * | 6/1980 | Morganroth | A45D 19/02 132/212 |

(Continued)

OTHER PUBLICATIONS

International Search Report and Written Opinion for PCT/US2017/056205 dated Jan. 2, 2018, 6 pages.

(Continued)

*Primary Examiner* — Nicholas D Lucchesi
(74) *Attorney, Agent, or Firm* — Seed IP Law Group LLP

(57) ABSTRACT

A device operable to apply coloring dye to hair while coordinating parting of the hair can include a reservoir sized and shaped to receive a coloring compound, a dispenser head in fluid communication with the reservoir, the dispenser head operable to dispense the coloring compound, and a parting comb attachment removably coupled to the reservoir. Related methods of use are also provided.

19 Claims, 6 Drawing Sheets

(56) References Cited

U.S. PATENT DOCUMENTS

| | | | | | |
|---|---|---|---|---|---|
| 4,289,153 | A | * | 9/1981 | Paccione | A45D 19/02 132/313 |
| 4,354,512 | A | | 10/1982 | Roppatte, Jr. | |
| 4,597,683 | A | | 7/1986 | Wittersheim et al. | |
| 4,602,651 | A | * | 7/1986 | Roppatte, Jr. | A45D 19/02 132/320 |
| 4,813,439 | A | * | 3/1989 | Morgan | A45D 19/02 132/112 |
| 4,934,388 | A | * | 6/1990 | Gibbs | A45D 19/02 132/112 |
| D342,584 | S | * | 12/1993 | Anderson | D28/7 |
| 5,482,058 | A | * | 1/1996 | Garconnet | A45D 24/26 132/115 |
| 5,499,637 | A | * | 3/1996 | Foti | A45D 19/02 132/112 |
| D370,783 | S | * | 6/1996 | Korte | 132/270 |
| 5,555,899 | A | * | 9/1996 | Foreman | A45D 19/02 132/114 |
| D403,164 | S | * | 12/1998 | Daughtry | D4/114 |
| 5,848,598 | A | * | 12/1998 | Walz | A45D 19/02 132/112 |
| 5,915,390 | A | | 6/1999 | Daughtry | |
| 6,062,230 | A | | 5/2000 | Kajgana | |
| 7,628,159 | B2 | * | 12/2009 | De Laforcade | A45D 19/02 132/112 |
| 7,934,512 | B2 | * | 5/2011 | Spagnuolo | A45D 24/26 132/112 |
| 2001/0018920 | A1 | * | 9/2001 | De Laforcade | A45D 19/02 132/114 |
| 2005/0082315 | A1 | * | 4/2005 | Hayakawa | A45D 24/28 222/192 |
| 2008/0308117 | A1 | | 12/2008 | Wright et al. | |
| 2019/0029387 | A1 | * | 1/2019 | Sadler | A45D 19/02 |

OTHER PUBLICATIONS

International Preliminary Report on Patentability for PCT/US2017/056205, dated Apr. 25, 2019, 6 pages.

* cited by examiner

COLOR APPLICATION BOTTLE WITH PARTING COMB ATTACHMENT AND RELATED METHODS OF USE

BACKGROUND

Technical Field

The present disclosure generally relates to color application bottles.

Description of the Related Art

People tend to change their natural color of hair for a wide variety of reasons. For example, people often visit hairstylists and/or barbers to have them apply a color dye to their hair. In other instances, people apply color dye to their hair themselves, for example, in the comfort of their homes. People can be motivated to change the natural color of their hair, e.g., dying, for a wide variety of reasons, such as to present a different look, a fashion statement, cultural influence, aging, etc. Typically, dying hair involves applying a color dye to the hair via a color applicator. In order to apply the color dye to desired areas of the hair, or even to all the hair, a person typically applies the color dye to portions of the hair, using a separate parting comb to part the hair, and in some instances using clips to hold together the parted hair, and then applying the color dye to areas of the hair that were not easily accessible. Such a color application process is time consuming, lacks efficiency, and can be costly. For example, in order to part the hair, a person may have to set aside the color applicator to pick up a separate parting comb. Or the person may have to use clips to hold the hair together while the separate parting comb can be picked up to part the hair. Such additional steps compromise efficiency.

BRIEF SUMMARY

Embodiments of devices and/or color application bottles described herein enable improvements in efficiency associated with hair color dying with efficient, compact, and robust form factors. For example, in one example embodiment, a device can be summarized as including a reservoir sized and shaped to receive a coloring compound, a dispenser head in fluid communication with the reservoir, the dispenser head operable to dispense the coloring compound, and a parting comb attachment removably coupled to the reservoir.

In one example embodiment, a color application bottle operable to dye hair can be summarized as including a reservoir sized and shaped to receive a coloring compound, a dispenser head in fluid communication with the reservoir, the dispenser head including a nozzle operable to dispense the coloring compound, and a parting comb attachment removably coupled to the reservoir.

In one example embodiment, a method for applying coloring dye to hair using a color application bottle having a reservoir, a dispenser head, and a parting comb attachment can be summarized as including lifting portions of hair, applying coloring dye disposed in the reservoir via the dispenser head to a first set of exposed hair, parting hair of the portions of hair via the parting comb attachment to expose a second set of exposed hair, and applying coloring dye disposed in the reservoir via the dispenser head to the second set of exposed hair.

DETAILED DESCRIPTION

In the following description, certain specific details are set forth in order to provide a thorough understanding of various disclosed embodiments or implementations. However, one skilled in the relevant art will recognize that embodiments or implementations may be practiced without one or more of these specific details, or with other methods, systems, components, materials, etc. In other instances, well-known structures associated with bottles and color applicators have not been shown or described in detail to avoid unnecessarily obscuring descriptions of the embodiments or implementations.

Unless the context requires otherwise, throughout the specification and claims which follow, the word "comprise" and variations thereof, such as "comprises" and "comprising," are to be construed in an open, inclusive sense, that is, as "including, but not limited to."

Reference throughout this specification to "one embodiment or implementation" or "an embodiment or implementation" means that a particular feature, structure or characteristic described in connection with the embodiment is included in at least one embodiment. Thus, the appearances of the phrases in one embodiment or implementation or in an embodiment or implementation in various places throughout this specification are not necessarily all referring to the same embodiment. Furthermore, the particular features, structures, or characteristics may be combined in any suitable manner in one or more embodiments or implementations.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings and Abstract of the Disclosure provided herein are for convenience only and do not interpret the scope or meaning of the embodiments or implementations.

Figure 1:
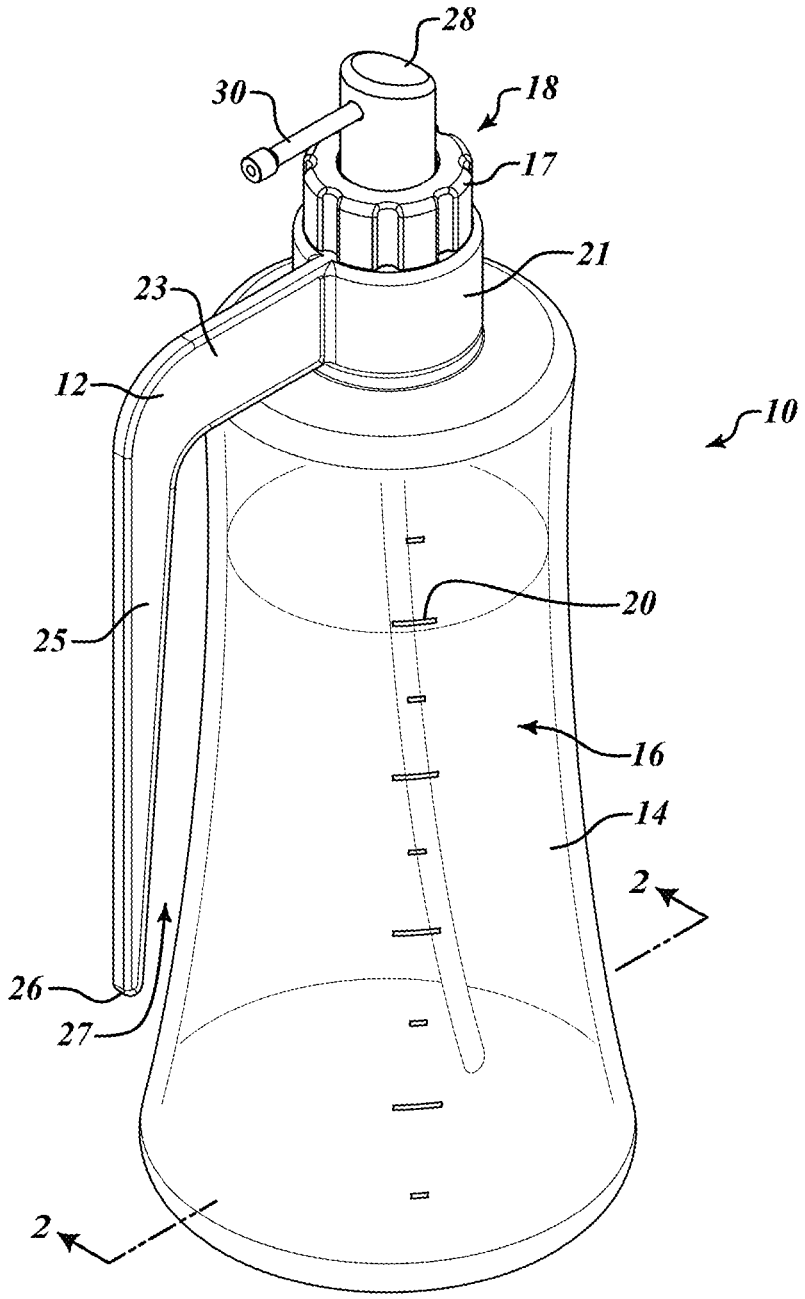
FIG. 1 is a perspective view of a color application bottle, according to one example embodiment.
Figure 2:
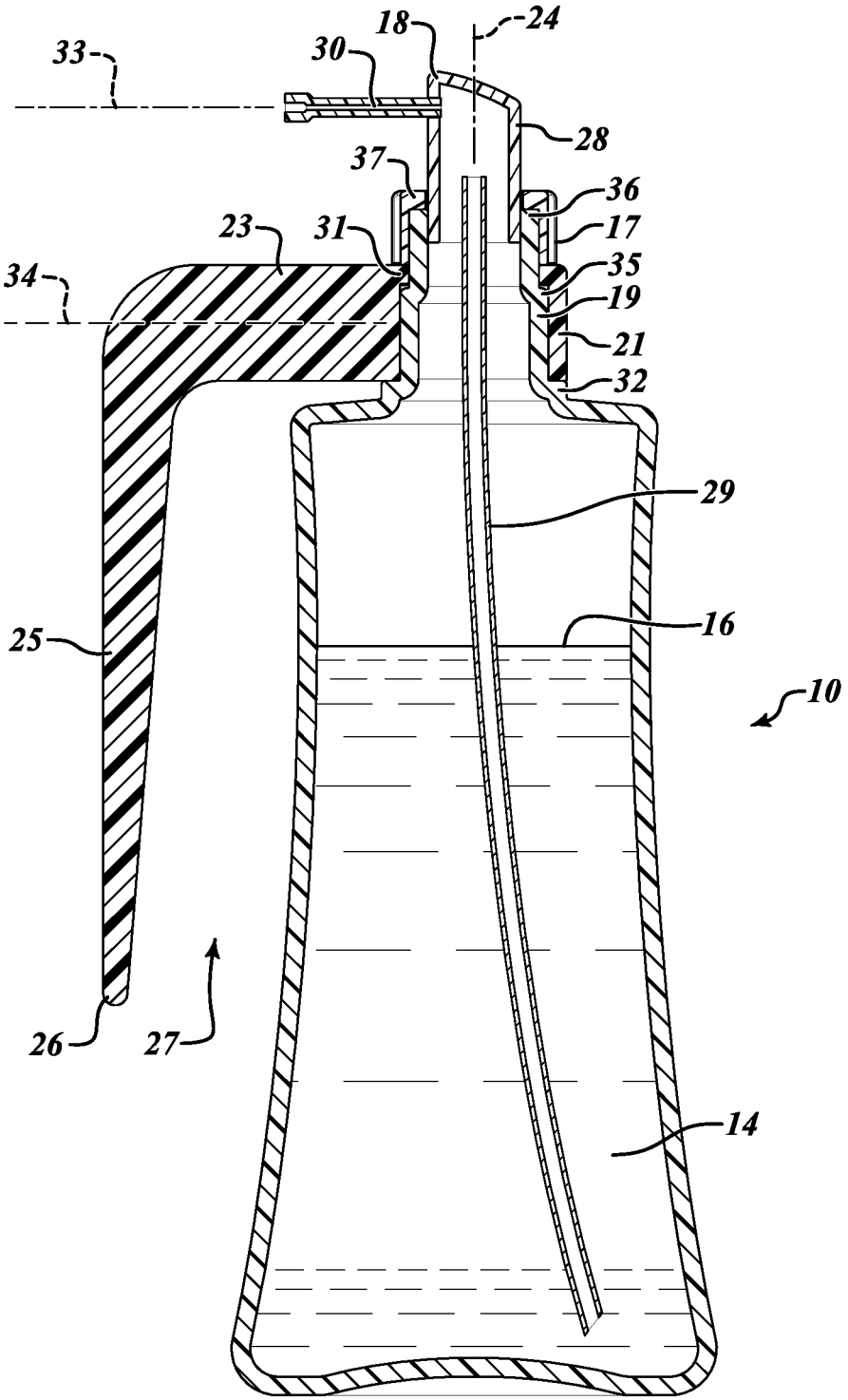
FIG. 2 is cross-sectional view of the color application bottle of FIG. 1, taken along lines 2-2.

FIGS. 1 and 2 illustrate a color application bottle 10, according to one example embodiment. The color application bottle 10 includes a removably coupled parting comb attachment 12 that may be used for hair styling. The color application bottle 10 includes a reservoir 14 for containing a coloring compound 16. The coloring compound 16 can include any hair dye composition, for example, permanent hair color dyes, demi-permanent dyes, semi-permanent dyes, or natural alternatives, such as henna. The color application bottle 10 also includes a dispenser head 18, which is configured to dispense the coloring compound 16.

The parting comb attachment 12 is removably secured to the color application bottle 10 via a neck portion 19 of the color application bottle 10. The neck portion 19 extends outwardly from a body of the reservoir 14 and is sized and shaped to removably coupleably receive the parting comb attachment 12. For example, in some embodiments, a cap 17 can be coupled to the neck portion 19 which can secure the parting comb attachment 12 to the reservoir 14. The cap 17, in some embodiments, can be screwed to the neck portion 19, which may allow the parting comb attachment 12 to be removed upon unscrewing of the cap 17. In some embodiments, the neck portion 19 can include one or more threads that removably coupleably receive the parting comb attachment 12, which may allow omission of the cap 17. In some embodiments, the neck portion 19 can be sized and shaped to removably coupleably receive the parting comb attachment 12 via a press-fit connection, wherein frictional forces secure the parting comb attachment 12 to the neck portion 19. In some embodiments, the parting comb attachment 12 can be removably coupled to the neck portion 19 via a detent mechanism, such as a tab, tongue, or ball disposed on the neck portion 19, which can engage with a lip, flange, or cavity disposed in the parting comb attachment 12, or vice versa. In general, the coupling of the parting comb attachment 12 to the color application bottle 10 via the neck portion 19 enables parting of hair in coordination with application of color compound 16.

The reservoir 14 can be formed of transparent or translucent materials, such as clear plastic or glass, to allow a user to view fluids in the interior of the reservoir. The reservoir 14 can also optionally include graduation markings 20 to assess the level of fluid in the reservoir 14, for example, coloring compound 16.

As described above, the parting comb attachment 12 is removably coupled to the neck portion 19 of the color application bottle 10. In particular, the parting comb attachment 12 includes a cylindrical collar 21 that is placed around the neck portion 19 between the dispenser head 18 and the reservoir 14. Again, as described above, in some embodiments, the collar 21 can include threads that are sized and shaped to couple to the neck portion 19. The collar 21 can include other features described above that facilitate removably coupling the parting comb attachment 12 to the neck portion 19. The collar 21, in some embodiments, can be approximately 1 inch in diameter and approximately ⅝ inches in height. An arm 23 extends from the collar 21 that is substantially perpendicular to a central axis 24 of the color application bottle 10. The arm 23, in some embodiments, can extend by approximately 2 inches before turning substantially parallel to the central axis 24 of the color bottle 10 and projecting approximately 4 inches as a parting comb portion 25. In some embodiments, as illustrated in FIGS. 1 and 2, the parting comb portion 25 has a generally tapered shape, where the parting comb portion 25 tapers toward a tip portion 26. The arm 23 and parting comb 25, in some embodiments, can be approximately ⅛ inches thick. In general, the parting comb attachment 12 allows for parting of hair in coordination with application of color to the hair. For example, a user can use the color application bottle 10 to apply color by dispensing or spraying coloring compound 16 via the dispenser head 18, as described in more detail below. Using the same color application bottle 10, the user can part the hair using the parting comb attachment 12, in particular, the parting comb 25, without having to use a physically separate and distinct parting comb. In this manner, the user can generate time savings and improve efficiencies.

Moreover, the embodiment of the parting comb attachment 12 can have other various shapes and sizes. For example, the collar 21 in other embodiments can be non-cylindrical in lieu of the cylindrical collar 21, such as cubical, rectangular, oval, triangular, or other regular or irregular shape. Further, the collar 21 can range from ⅜ inches to approximately 2 or more inches in height. In some embodiments, the collar 21 can range from approximately ½ inches to approximately 2 or more inches in diameter. Alternatively, in some embodiments, the collar 21 can have an open section, thereby permitting the collar 21 to be snapped around the neck portion 19, for example, via a detent mechanism, without requiring removal of the dispenser head 18, in particular, a nozzle 30, thereof. Further, in some embodiments, the collar 21 can be formed integrally with the color application bottle 10 as a one-piece construction thereby eliminating the collar 21 as a separate component. In some embodiments, the collar 21 can be sized and shaped to encircle or attach to the reservoir 14.

Moreover, in some embodiments, the arm 23 of the parting comb attachment 12 can also be variously sized and shaped. For instance, in some embodiments, the arm 23 can extend approximately 1 to 5 inches and can be approximately 1/16 to 1 inch in width and approximately ¼ to 1 inch in height. Further, various sizes and shapes of the arm 23 are within the scope of the disclosed subject matter. For example, in some embodiments, the arm 23 can be flat, cubical, cylindrical, oval, or other regular or irregular shape, which may vary along a length. For instance, the arm 23 can taper to a thinner width and height commensurate with the parting comb 25 along its length. The arm 23, in some embodiments, can project perpendicularly or non-perpendicularly, such as up, down, or curved relative to the central axis 24 of the color application bottle 10 and/or neck portion 19. The parting comb 25 of the parting comb attachment 12 can extend at different lengths, such as between approximately 1 inch to 8 inches. In some embodiments, the parting comb 25 can be approximately ⅙ inches to ⅕ inches thick and approximately ¼ to 1 inch in height. The parting comb 25 can taper along its length to the tip portion 26, as described above, or can have a substantially uniform width/thickness/height. The tip portion 26 of the parting comb 25 can be pointed, round (ball), wide, narrow, or straight.

As illustrated in FIGS. 1 and 2, the parting comb 25 is spaced apart from the reservoir 14 by a parting space 27. In particular, the parting space 27 is sized to allow hair to be received therein allowing a user to part the hair via the parting comb 25, which allows access to apply the coloring compound 16 via the dispenser head 18.

In some embodiments, the color application bottle 10 can be of various sizes and shapes. For example, the in some embodiments, the color application bottle 10 can have a substantially cylindrical shape defined, in part, by the reservoir 14. In some embodiments, the color application bottle 10 can be approximately 6 inches in height and approximately 3 inches in diameter with a recessed waste portion for ergonomics. However, other sizes and shapes are within the scope of the disclosed subject matter; for example, in some embodiments the color application bottle 10 can have a substantially cubical, spherical, triangular, or other regular or irregular shape. In some embodiments, the color application bottle 10 can range in size from approximately 1 inch to 12 inches in height and from 1 inch to 8 inches in width, and can have recessed, non-recessed, or distended waste portions. A volume of the reservoir 14 of the color application bottle 10 can therefore range from a few ounces to a liter or more.

As illustrated in FIGS. 1 and 2, the dispenser head 18 is a pump action dispenser with a thumb or finger interface 28, for example, a push button, that is in fluid communication with the coloring compound 16 disposed in the reservoir 14, and at least a portion of the thumb or finger interface 28 is received in the neck portion 19. For example, the dispenser head 18 includes a conduit 29 that is coupled to the thumb or finger interface 28 and extends internally into the reservoir 14. In this manner, the dispenser head 18 is in fluid communication with the coloring compound 16 disposed in the reservoir 14. Thus, when an end user actuates the thumb or finger interface 28, for example, by depressing the thumb or finger interface 28, the dispenser head 18 draws the coloring compound 16 for dispensing onto hair of a person. In particular, the dispenser head 18 includes a nozzle 30 that is fluidly coupled to the thumb or finger interface 28. The nozzle 30, in some embodiments, extends outwardly from the thumb interface 28 in a direction that is substantially perpendicular to the central axis 24 of the color application bottle 10. The nozzle 30 is sized and shaped to spray or, more generally, dispense the coloring compound 16 onto the hair of a person. In some embodiments, the nozzle 30 can be sized and shaped to cause a conical dispensation of the coloring compound 16. In other embodiments, however, the nozzle 30 can yield other types of dispensation of the coloring compound 16. For example, a conical type nozzle, such as nozzle 30, can be substituted with a stream, mist, or flat dispenser head.

In some embodiments, the nozzle 30 can be removably coupled to the thumb or interface 28. For example, the nozzle 30 can be removably coupled to the thumb or finger interface 28 via a threaded coupling structure, detent mechanism, frictional fit coupling, etc. Thus, in such embodiments, the nozzle 30 can be removed and nozzles that yield different dispensations of the coloring compound 16 can be coupled to the thumb or finger interface 28. As such, the various different nozzles can be interchangeably used with the thumb or finger interface 28.

The dispenser head 18 can be removably coupled to the reservoir 14. For example, in some embodiments, the dispenser head 18, or at least a portion thereof, can be received in the neck portion 19 and the cap 17 can removably couple the dispenser head 18 to the reservoir 14. In other embodiments, the dispenser head 18 can be coupled to the reservoir 14 via a detent mechanism, press-fit installation, and other coupling structures described herein.

As illustrated in FIGS. 1 and 2, the dispenser head 18 is generally positioned to align with the parting comb attachment 12. For example, the dispenser head 18 has a longitudinal axis 33 that is substantially parallel to a longitudinal axis 34 of the arm 23. In some embodiments, the longitudinal axis 33 of the dispenser head 18 is substantially perpendicular to the central axis 24 of the color application bottle 10. In this manner, when coloring compound 16 is applied via the nozzle 30, a user can part hair using the parting comb attachment 12 without having to turn or rotate the color application bottle 10 to part the hair.

In some embodiments, the collar 21 includes a first lip 31 extending radially inward from the collar 21 with the cap 17 seating on the first lip 31 of the collar 21. Further, the neck portion 19 of the color application bottle 10 may include a first ledge 32 and a second ledge 35 and the collar 21 seats with the first ledge 32 and the second ledge 35 of the neck portion 19 with the first lip 31 adjacent the second ledge 35 and the neck portion 19. The neck portion 19 may further include a third ledge 36 and the cap 17 includes a second lip 37 extending radially inward from the cap 17 with the cap 17 seating on the collar 21 and the third ledge 36 of the neck portion 19 with the second lip 37 of the cap 17 adjacent the third ledge 37 and the dispenser head 18. In some embodiments, each of the ledges 32, 35, 36 of the neck portion 19 define a radial constriction of a diameter of the neck portion 19.

Figure 3:
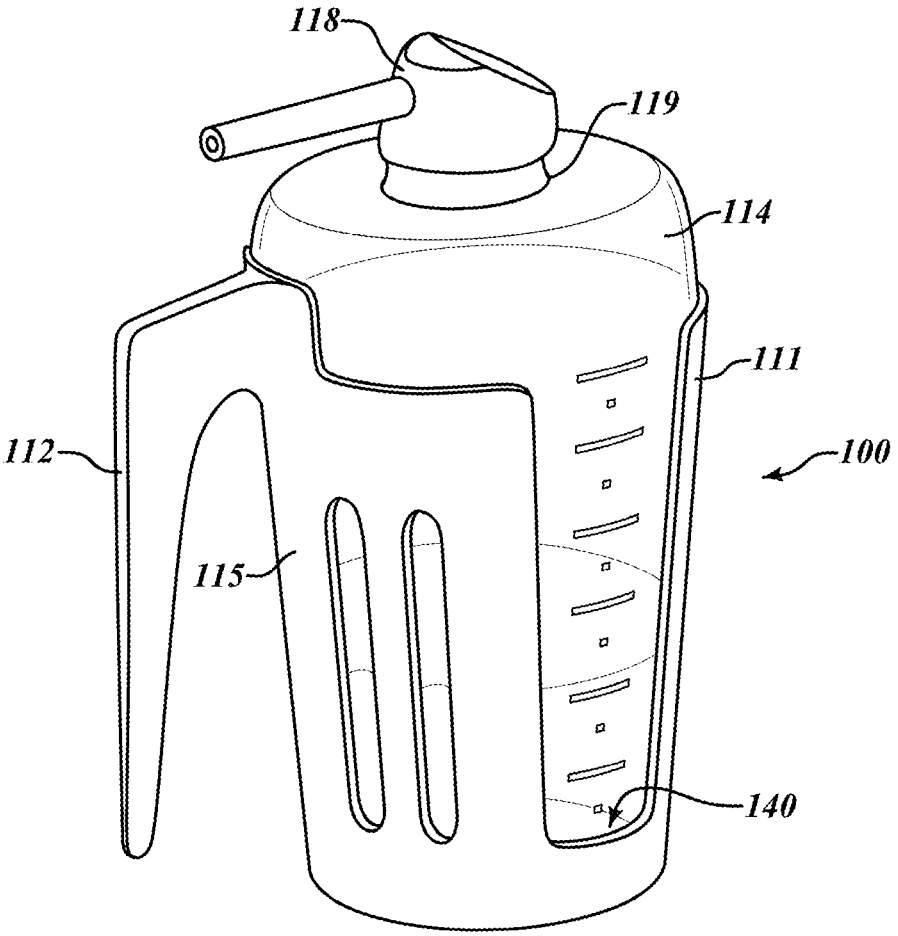
FIG. 3 is a perspective view of a color application bottle, according to one example embodiment.

In use, therefore, a user may apply coloring compound 16 to hair of a person, for example, a customer, or the user himself/herself, via the dispenser head 18. For example, the user may lift portions of hair to obtain access to hair proximate to the scalp. Upon application of a desired amount of coloring compound 16, the user may part the hair using the parting comb attachment 12 to obtain access to other portions of the hair that were lifted by the user. For example, while parting, the parted hair can be received in the parting space 27. Subsequently, the user may apply a desired amount of coloring compound 16. Subsequently, the user may continue to repeatedly part the hair using the parting comb attachment 12 and apply the coloring compound 16 until desired results are achieved. FIG. 3 illustrates a color application bottle 100, according to another example embodiment. The color application bottle 100 provides a variation in which a parting comb attachment 112, instead of a collar for securing to a neck portion 119, includes a container 111 for coupling to a reservoir 114 of the color application bottle 100. For example, as illustrated in FIG. 3, the parting comb attachment 112 includes a housing portion 115 that includes an aperture 140 that is sized and shaped to receive the reservoir 114. In this manner, the color application bottle 100 enables use of a single parting comb attachment with multiple reservoirs 114, thereby enabling interchanging of the reservoirs 114 without removal of a dispenser head 118.

Figure 4:
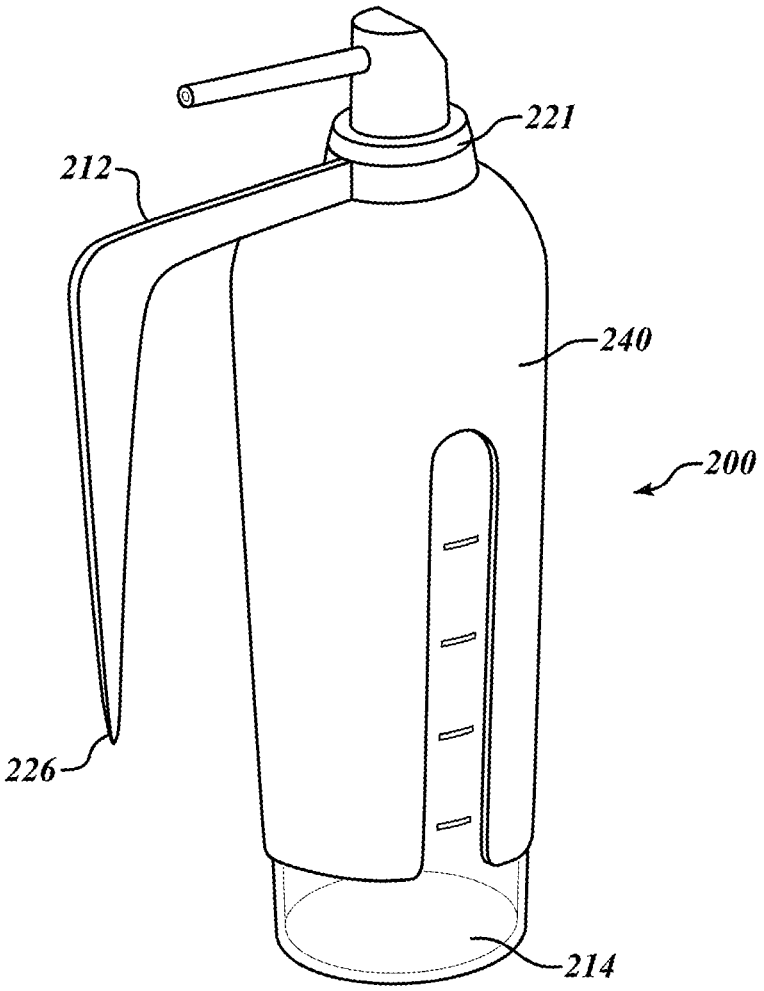
FIG. 4 is a perspective view of a color application bottle, according to one example embodiment.

FIG. 4 illustrates color application bottle 200 according to another example embodiment. The color application bottle 200 provides a variation in which a parting comb attachment 212 includes a collar 221 that extends downward around a body of a reservoir 214 as a sleeve 240. Such an embodiment can provide improved ergonomics with the addition of various materials or contours to increase the comfort and usability of the reservoir 214, tip portion 226 of the parting comb attachment 212, and the parting comb attachment 212 in general.

Figure 5A:
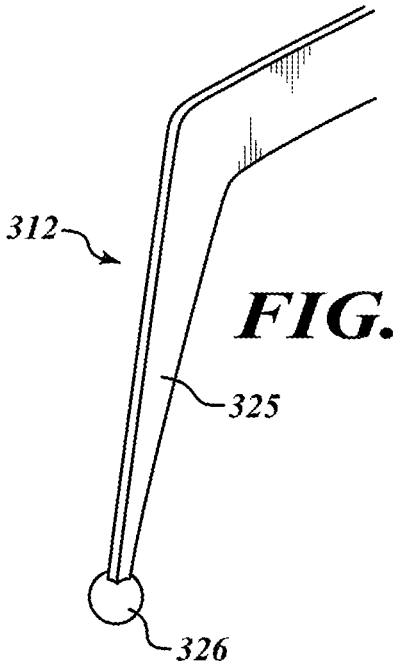
FIG. 5A is a perspective view of a parting comb of a color application bottle, according to one example embodiment.
Figure 5B:
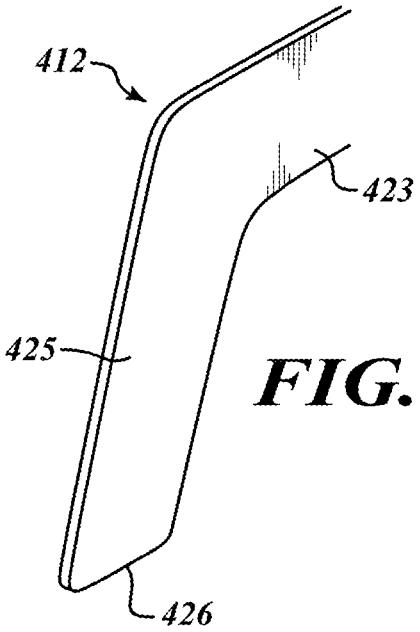
FIG. 5B is a perspective view of a parting comb of a color application bottle, according to one example embodiment.
Figure 5C:
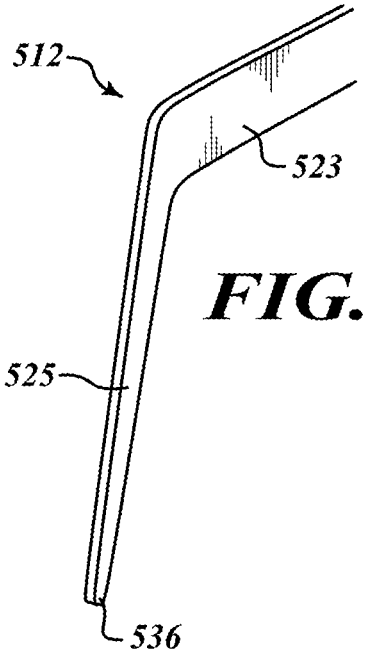
FIG. 5C is a perspective view of a parting comb of a color application bottle, according to one example embodiment.
Figure 5D:
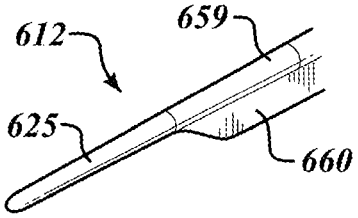
FIG. 5D is a perspective view of a parting comb of a color application bottle, according to one example embodiment

As described above, a parting comb attachment, e.g., parting comb attachment 12, 112, 212, etc., can include other shapes and sizes. For example, FIG. 5A illustrates a parting comb attachment 312 according to another example embodiment. The parting comb attachment 312 provides a variation in which a tip portion 326 of a parting comb 325 is sized and shaped as a substantially round ball. FIG. 5B illustrates a parting comb attachment 412 according to another example embodiment. The parting comb attachment 412 provides a variation in which a tip portion 426 is substantially flat and a parting comb 425 has a substantially uniform width and a width that is substantially similar to a width of an arm 423. FIG. 5C illustrates a parting comb attachment 512 according to another example embodiment. The parting comb attachment 512 provides a variation in which a tip portion 536 is substantially flat and a parting comb 525 has a width that is less than a width of an arm 523. FIG. 5D illustrates a parting comb attachment 612 according to another example embodiment. The parting comb attachment 612 provides a variation in which a parting comb 625 has a substantially cylindrical shaped pin portion 659 positioned above a connecting portion 660. Moreover, the parting combs described herein, e.g., parting comb 25, 325, 425, 525, 625, etc., in some embodiments, can have a plurality of teeth that are spaced apart to receive therein portions of hair.

Figure 6A:
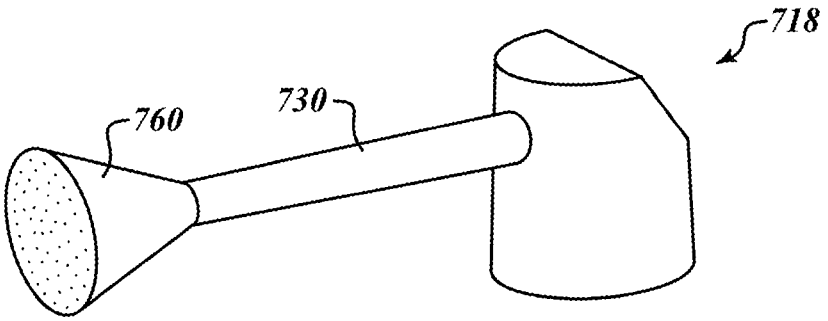
FIG. 6A is a perspective view of a nozzle of a color application bottle, according to one example embodiment.
Figure 6B:
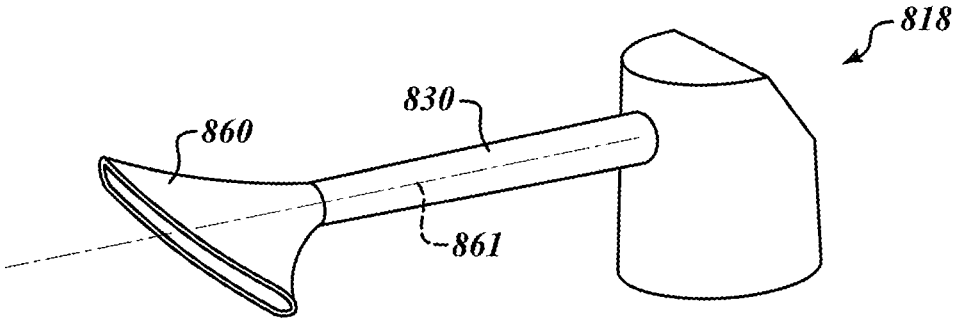
FIG. 6B is a perspective view of a nozzle of a color application bottle, according to one example embodiment.

As described above, a dispenser head, e.g., dispenser head 18, 118, can include other shapes and sizes. For example, FIG. 6A illustrates a dispenser head 718 according to another example embodiment. The dispenser head 718 provides a variation in which a nozzle 730 includes cone portion 760 through which a coloring compound, e.g., coloring compound 16, can be dispensed. FIG. 6B illustrates a dispenser head 818 according to another example embodiment. The dispenser head 818 provides a variation in which a nozzle 830 includes a dispenser portion 860 that is oriented angularly relative to a longitudinal axis 861 of the nozzle 830.

The particulars shown herein are by way of example. In this regard, no attempt is made to show structural details of the disclosed subject matter in more detail than is necessary for the fundamental understanding of the disclosed subject matter. The description taken with the drawings and/or examples make apparent to those skilled in the art how the several forms of the disclosed subject matter may be embodied in practice.

As used herein and unless otherwise indicated, the terms "a" and "an" are taken to mean "one," "at least one" or "one or more." Unless otherwise required by context, singular terms used herein shall include pluralities and plural terms shall include the singular.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural and singular number, respectively. Additionally, the words "herein," "above," and "below" and words of similar import, when used in this application, shall refer to this application as a whole and not to any particular portions of the application.

U.S. Provisional Patent Application No. 62/407,433, filed Oct. 12, 2016, to which the present application claims priority, is hereby incorporated herein by reference in its entirety.

Specific elements of any foregoing embodiments can be combined or substituted for elements in other embodiments. Furthermore, while advantages associated with certain embodiments of the disclosure have been described in the context of these embodiments, other embodiments may also exhibit such advantages, and not all embodiments need necessarily exhibit such advantages to fall within the scope of the disclosure.

While preferred and alternate embodiments have been illustrated and described, as noted above, many changes can be made without departing from the spirit and scope of the disclosure. Accordingly, the inventive concept is not limited by the disclosure of these preferred and alternate embodiments.

Moreover, the various embodiments described above can be combined to provide further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A device, comprising:
- a reservoir sized and shaped to receive a coloring compound;
- a dispenser head in fluid communication with the reservoir, the dispenser head operable to dispense the coloring compound;
- a parting comb attachment removably coupled to the reservoir, including:
  - a collar with a lip extending radially inward from the collar;
  - an arm portion coupled to the collar; and
  - a parting comb portion coupled to the arm portion, the parting comb portion spaced from the reservoir and extending opposite from the dispenser head; and
- a cap coupled to the reservoir and structured to removably secure the parting comb attachment and the dispenser head to the reservoir, the cap seating on the lip of the collar of the parting comb attachment.

2. The device of claim 1 wherein the arm portion of the parting comb attachment has a width that is constant over a length of the arm portion and the parting comb portion has a width that is tapered over a length of the parting comb portion.

3. The device of claim 2 wherein the width of the arm portion is greater than the width of the parting comb portion.

4. The device of claim 1 wherein the reservoir includes a neck portion, the neck portion sized and shaped to coupleably receive the dispenser head.

5. The device of claim 1 wherein the dispenser head includes a thumb interface, the thumb interface moveable to dispense the coloring compound.

6. The device of claim 1 wherein the arm portion of the parting comb attachment extends substantially perpendicularly to a central axis of the device.

7. The device of claim 1 wherein the dispenser head includes a nozzle, the nozzle operable to spray or dispense the coloring compound.

8. The device of claim 7 wherein the nozzle is parallel to the arm portion of the parting comb attachment.

9. The device of claim 1 wherein the reservoir is formed of a transparent material.

10. A color application bottle operable to dye hair, the color application bottle comprising:
- a reservoir sized and shaped to receive a coloring compound;
- a dispenser head in fluid communication with the reservoir, the dispenser head including a nozzle operable to dispense the coloring compound;
- a parting comb attachment having a collar with a lip extending radially inward from the collar; and
- a cap coupled to the reservoir and structured to removably secure the parting comb attachment and the dispenser head to the reservoir, the cap seating on the lip of the collar of the parting comb attachment.

11. The color application bottle of claim 10 wherein the collar of the parting comb attachment is removably coupled to a neck portion of the reservoir by the cap.

12. The color application bottle of claim 10 wherein the parting comb attachment includes:
- the collar of the parting comb attachment removably coupled to the reservoir;
- an arm that extends from the collar in a direction that is substantially perpendicular to a central axis of the color application bottle; and a parting comb that extends from the arm in a direction opposite from the dispenser head.

13. The color application bottle of claim 12 wherein the parting comb is spaced apart from the reservoir to define a parting space which is sized to receive hair therein and the arm of the parting comb attachment has a width that is tapered over a length of the arm.

14. A device, comprising:

a reservoir sized and shaped to receive a coloring compound;

a dispenser head in fluid communication with the reservoir, the dispenser head including a nozzle operable to dispense the coloring compound;

a parting comb attachment removably coupled to the reservoir, the parting comb attachment including a collar portion having a first lip, an arm portion coupled to the collar portion, and a parting comb portion coupled to the arm portion, the parting comb portion spaced from the reservoir and extending opposite from the dispenser head; and a cap coupled to the reservoir and structured to removably secure the parting comb attachment and the dispenser head to the reservoir, the cap seating on the first lip of the parting comb attachment.

15. The device of claim 14 wherein the reservoir has a neck portion with a first ledge and a second ledge and the first lip of the collar portion of the parting comb attachment extends radially inward from the collar portion.

16. The device of claim 15 wherein the collar portion of the parting comb attachment seats with the first ledge and the second ledge of the neck portion of the reservoir with the first lip of the collar portion adjacent the second ledge and the neck portion of the reservoir.

17. The device of claim 15 wherein the neck portion of the reservoir includes a third ledge and the cap includes a second lip extending radially inward from the cap.

18. The device of claim 17 wherein the cap seats with the collar portion and the third ledge of the neck portion of the reservoir with the second lip of the cap adjacent the third ledge and the dispenser head.

19. The device of claim 14 wherein the reservoir has a neck portion with a plurality of ledges that each define a radial constriction of a diameter of the neck portion.

* * * * *